US005693943A

United States Patent [19]

Tchernihovski et al.

[11] Patent Number: 5,693,943

[45] Date of Patent: Dec. 2, 1997

[54] PASSIVE INFRARED INTRUSION DETECTOR

[75] Inventors: Nahum Tchernihovski, Ramat Hasharon; Boris Zhevelev, Rishon Lezion; Mark Moldavski, Petah Tikva; Yaacov Kotlicki, Ramat Gan, all of Israel

[73] Assignee: Visionic Ltd., Tel Aviv, Israel

[21] Appl. No.: 643,125

[22] Filed: May 2, 1996

[51] Int. Cl.[6] ..... G08B 13/19

[52] U.S. Cl. ..... 250/342; 250/DIG. 1

[58] Field of Search ..... 250/342, 353, 250/DIG. 1

[56] References Cited

U.S. PATENT DOCUMENTS

| | | | |
|---|---|---|---|
| 3,858,192 | 12/1974 | Fischer . | |
| 4,242,669 | 12/1980 | Crick . | |
| 4,604,524 | 8/1986 | Kotlicki et al. . | |
| 4,709,153 | 11/1987 | Schofield . | |
| 4,752,768 | 6/1988 | Steers et al. . | |
| 4,752,769 | 6/1988 | Knaup et al. | 250/DIG. 1 |
| 4,764,755 | 8/1988 | Pedtke et al. . | |
| 4,912,748 | 3/1990 | Horii et al. | 250/DIG. 1 |
| 4,982,094 | 1/1991 | Matsuda . | |
| 5,077,549 | 12/1991 | Hershkovitz et al. . | |
| 5,084,696 | 1/1992 | Guscott et al. . | |
| 5,237,330 | 8/1993 | Yaacov et al. . | |

FOREIGN PATENT DOCUMENTS

| | | | |
|---|---|---|---|
| 1-162186 | 6/1989 | Japan | 250/DIG. 1 |
| 2-36391 | 2/1990 | Japan | 250/DIG. 1 |
| 3-75584 | 3/1991 | Japan | 250/DIG. 1 |
| 3-238388 | 10/1991 | Japan | 250/DIG. 1 |
| 3-238390 | 10/1991 | Japan | 250/DIG. 1 |
| 3-293585 | 12/1991 | Japan | 250/DIG. 1 |

*Primary Examiner*—Edward J. Glick
*Attorney, Agent, or Firm*—Ladas & Parry

[57] ABSTRACT

An intrusion detector for supervising a region including a sensor which views a plurality of fields-of-view of the region and provides an output responsive to motion of an infrared radiation source between the fields-of-view, a first filter which provides a first filtered output based on a first, predetermined, detection pulse frequency range of the sensor output, a second filter which provides a second filtered output based on a second, predetermined, detection pulse frequency range of the sensor output and processing circuitry which receives the first and second filtered outputs and detects, in either or both of the filtered outputs, a sequence of detection pulses indicating an intrusion condition.

35 Claims, 9 Drawing Sheets

PASSIVE INFRARED INTRUSION DETECTOR

FIELD OF THE INVENTION

The present invention relates to intrusion detectors in general and, more particularly, to signal processing in passive infrared detectors.

SOFTWARE APPENDIX

Submitted herewith is a software appendix.

BACKGROUND OF THE INVENTION

Passive infrared detectors are widely used in intruder, e.g. burglar alarm systems. The infrared detectors of such systems generally respond to radiation in the far infrared range, preferably 7–14 micrometers, as typically irradiated from an average person. A typical passive infrared detector includes a pyroelectric sensor adapted to provide an electric output in response to changes in radiation at the desired wavelength range. The electric output is then amplified by a signal amplifier and processed by signal detection circuitry.

To detect movement of a person in a predefined area, typically a room, passive infrared detectors are provided with a discontinuously segmented optical element, e.g. a segmented lens or mirror having at least one optical segment, wherein each segment of the lens or mirror collects radiation from a discrete, narrow, field-of-view such that the fields-of-view of adjacent segments do not overlap. Thus, the pyroelectric sensor receives external radiation through a segmented field-of-view, including a plurality of discrete detection zones separated by a plurality of discrete no-detection zones. The system detects movement of a person from a given zone to an adjacent zone by detecting, for example, a relatively sharp drop or a relatively sharp rise in the electric output of the pyroelectric sensor.

It is appreciated that abrupt changes in ambient temperature may result in abrupt changes in the output of the pyroelectric sensor and, thus, false alarms may occasionally be detected. To avoid this problem, most intruder alarm systems use a dual-element pyroelectric sensor having two, adjacent, pyroelectric sensor elements. The two elements are arranged vis-a-vis the segmented optics such that the two elements have interlaced, non-overlapping, fields-of-view. The two elements are electrically configured to provide opposite polarity electrical outputs, such that the net signal received from the sensor is substantially zero when both sensor elements simultaneously detect radiation from the same source. The net signal is greater than zero when the radiation is detected by the two elements non-simultaneously, for example a moving source will generally be detected first by one of the elements and then by the other element.

Intrusion detectors using dual-element sensors are generally more reliable and have a better detection resolution than corresponding single element sensors. However, even dual-element sensor systems occasionally generate false alarms due to uncontrolled effects of noise including, inter alia, internal system noise, radio frequency (RF) and other external noise, or random noise known as "spikes". These uncontrolled effects are generally overcome by increasing detection thresholds or by using pulse-counting techniques known in the art, thereby decreasing the detection sensitivity.

As long as there are no intruders in the supervised area, the amplified sensor output consists of a substantially constant, typically zero, signal which is subject only to the above mentioned effects. However, in an intrusion situation, the amplified sensor output includes a series of pulses responsive to movement of the intruder across a series of adjacent detection zones. Since pulses in the amplified output may also result from occasional noise, genuine intrusions are typically verified by detecting a series of pulses, typically at least three pulses, to avoid false alarms.

In existing systems, detection of intruder motion is generally dependent on two factors, namely, the distance of the intruder from the detector and the angular velocity of the intruder relative to the detector. The distance of the intruder generally controls the magnitude of the received IR energy and thus of the amplified sensor signals, whereby a close intruder will normally generate a stronger signal than a far intruder. The angular velocity of the intruder, i.e. the rate at which the intruder moves from one detection zone to the next, generally controls the frequency of pulses in the amplified sensor output. Thus, the frequency of detection pulses generated by a "fast sweeping" intruder is higher than the frequency of detection pulses generated by a "slow sweeping" intruder. It should be noted that the "sweeping" rate, i.e. the angular velocity, of a given intruder is a function of the linear velocity of the intruder, the direction of motion of the intruder and the distance of the intruder from the intrusion detector.

For optimal coverage of most intrusion situations, wide range amplifiers are generally used to amplify the signals produced by the pyroelectric sensor. Such amplifiers respond to a wide range of detection pulse frequencies. However, at very high angular velocities, typically more than approximately 10 degrees per second, wide range amplifiers do not provide sufficient separation between consecutive detection pulses whereby there are overlaps between adjacent edges of consecutive pulses. Thus, detection signals corresponding to fast sweeping intruders typically include super-peak structure, each such structure consisting of series of local peaks superposed on a single, wide, base pulse. In a fast sweeping intrusion situation, where the amplified signal exceeds the detection threshold across entire super-peak structures, the structures are misidentified as single detection pulses and intrusions are not detected.

Another problem of detectors using wide frequency range amplifiers is their poor amplification at extreme, i.e. very high or very low, frequencies. It should be noted that distant intruders generally produce weak signals having a low detection pulse frequency and, therefore, such intruders are often ignored by detectors using wide range amplifiers.

Passive infrared intrusion detectors are described, for example, in U.S. Pat. No. 4,709,153, U.S. Pat. No. 4,752,768, U.S. Pat. 4,242,669, U.S. Pat. No. 4,982,094, U.S. Pat. No. 5,084,696, U.S. Pat. No. 5,077,549 and U.S. Pat. No. 4,764,755.

SUMMARY OF THE INVENTION

It is an object of the present invention to provide a passive infrared intrusion detector capable of detecting intruders having a high angular velocity, i.e., a high sweeping rate, relative to the detector. It is a further object of the present invention to provide a passive infrared detector capable of detecting intruders, particularly distant intruders, having a low angular velocity relative to the detector.

According to one aspect of the present invention, the detector identifies multi-peak pulses, also referred to herein as super-pulses, in an amplified output of a pyroelectric sensor. Each such super-pulse includes a series of narrow local peaks superposed on a wide base pulse. The detector preferably uses local detection thresholds to discriminate between the local peaks in the super-pulses. The local detection thresholds are preferably dynamically adjusted according to the time intervals between consecutive peaks. This dynamic threshold adjustment improves the ability of the detector to discriminate between local peaks in the super-pulses.

According to another aspect of the present invention, the intrusion detector includes at least two amplifiers adapted for amplifying at least two, respective, detection pulse frequency bands of the pyroelectric sensor output. Preferably, in accordance with this aspect of the present invention, the detector includes a high frequency range amplifier and a low frequency range amplifier. The high frequency range amplifier responds to sensor signals of fast sweeping intruders, for which a finer separation between pulses is required. The low frequency range amplifier provides enhanced amplification of sensor signals of slow sweeping and/or distant intruders.

There is thus provided, in accordance with a preferred embodiment of the invention an intrusion detector for supervising a region comprising:

a sensor which views a plurality of fields-of-view of the region and provides an output responsive to motion of an infrared radiation source between the fields-of-view;

a first filter which provides a first filtered output based on a first, predetermined, detection pulse frequency range of the sensor output;

a second filter which provides a second filtered output based on a second, predetermined, detection pulse frequency range of the sensor output; and processing circuitry which receives the first and second filtered outputs and detects, in either or both of the filtered outputs, a sequence of detection pulses indicating an intrusion condition.

Preferably, the processing circuitry comprises a first comparator which compares the first filtered output to at least one first threshold and a second comparator which compares the second filtered output to at least one second threshold.

Preferably, the first comparator comprises a first window comparator and the at least one first threshold comprises first upper and lower thresholds and wherein said second comparator comprises a second window comparator and the at least one second threshold comprises second upper and lower thresholds.

Preferably, the first and second thresholds are dynamically adjusted based on ambient conditions.

Preferably, said processing circuitry comprises a digital processor.

In a preferred embodiment of the invention the first frequency range comprises a high frequency range and the second frequency range comprises a low frequency range. Preferably, the first frequency range is between about 3 Hz to about 10 Hz. Preferably, the second frequency range is between about 0.1 to about 3 Hz, preferably between 0.1 and 2 Hz.

Preferably, the detector includes an alarm circuit which provides a sensible indication when said processing circuitry detects said sequence of detection pulses.

In a preferred embodiment of the invention the first and second filters comprise respective first and second amplifiers, such that the first and second filtered signals are amplified signals.

There is further provided in accordance with a preferred embodiment of the invention, a method of supervising a region, comprising:

viewing a plurality of fields-of-view of the region;

sensing incident infrared radiation from the region and providing a sensor signal responsive to motion of an infrared radiation source between the fields-of-view;

detecting a series of extremum values in the sensor signal; and detecting motion of the infrared radiation source based on time and amplitude differences between at least some of the extremum values in said series.

In a preferred embodiment of the invention detecting motion of the infrared radiation source comprises thresholding a given extremum value of the amplified sensor signal using a threshold dependent on the time interval between the given extremum value and the last previous extremum value.

The method preferably comprises dynamically adjusting said threshold in accordance with ambient conditions.

There is further provided, in accordance with a preferred embodiment of the invention, an intrusion detector for supervising a region comprising:

a sensor which views a plurality of fields-of-view of the region and provides an output responsive to motion of an infrared radiation source between the fields-of-view;

a processor which detects a series of extremum values in the sensor output and determines motion of the infrared radiation source based on time and amplitude differences between at least some of the extremum values in said series.

Preferably, the processor detects motion of the infrared radiation source by thresholding a given extremum value of the amplified sensor signal using a threshold dependent on the time interval between the given extremum value and the last previous extremum value.

BRIEF DESCRIPTION OF THE DRAWINGS

The present invention will be better understood from the following detailed description of preferred embodiments of the present invention, taken in conjunction with the following drawings in which.

DETAILED DESCRIPTION OF THE PREFERRED EMBODIMENTS

Figure 1A:
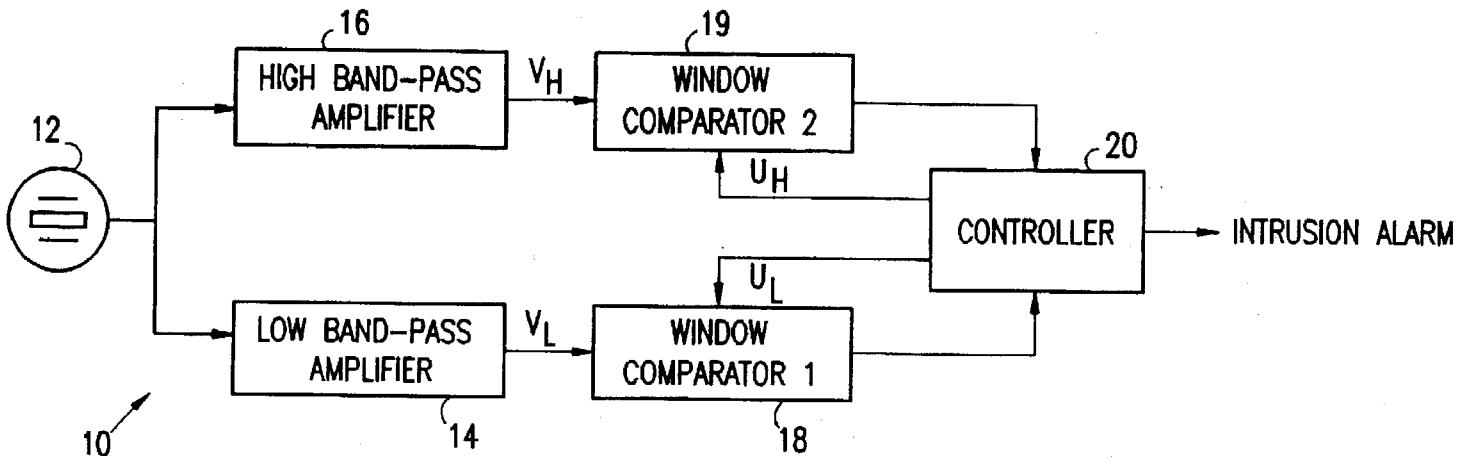
FIG. 1A is a schematic, block diagram, illustration of intrusion detection circuitry in accordance with one preferred embodiment of the present invention.

Reference is now made to FIG. 1A which schematically illustrates intrusion detection circuitry 10 in accordance with one preferred embodiment of the present invention. Circuitry 10 is connected to a far infrared sensor 12, preferably a pyroelectric sensor, which produces an electric output in response to radiation in a far infrared wavelength range. Sensor 12 is preferably responsive to infrared radiation in a wavelength range of between approximately 7 micrometers and approximately 14 micrometers, which is a typical radiation range of the human body. Sensor 12 preferably views a plurality of fields-of-view of a supervised region, preferably through segmented optics (not shown in the drawings) such as a segmented Fresnel lens. As known in the art, the plurality of fields-of-view of sensor 12, also referred to herein as detection zones are preferably discrete, i.e., non-overlapping zones. The electric output produced by sensor 12, which preferably includes a dual element sensor, comprises a pulse for each time a far infrared source exits one of the detection zones or enters an adjacent zone.

It is appreciated that the frequency at which detection pulses are generated by sensor 12 is dependent on the angular velocity, i.e. the sweeping rate, of the infrared source being detected. In a preferred embodiment of the present invention, as shown in FIG. 1, the output signal produced by sensor 12 is amplified by a low frequency range amplifier 14 or a high frequency range amplifier 16, which are both connected to the output of sensor 12.

When sensor 12 generates a low frequency signal, for example a signal responsive to a distant, slow moving, intruder, the signal is efficiently amplified by low frequency range amplifier 14 to produce an amplified signal component $V_L$. The gain of amplifier 14 at low detection pulse frequencies, typically frequencies of between 0.1 and 1 pulses per second, is higher than that of wide range amplifiers, ensuring enhanced amplification of the typically weak signals generated by distant intruders.

When sensor 12 generates a high frequency signal, for example a signal responsive to a near, fast moving, intruder, the signal is efficiently amplified by high frequency range amplifier 16 to produce an amplified signal component $V_H$. At high detection pulse frequencies, typically between 2 Hz and 10 Hz, amplifier 16 has a higher detection pulse resolution, i.e. a better separation between adjacent detection pulses, than that of wide range amplifiers. This enables detection of fast sweeping intruders which are generally not detected by conventional intrusion detectors.

Figure 2A:
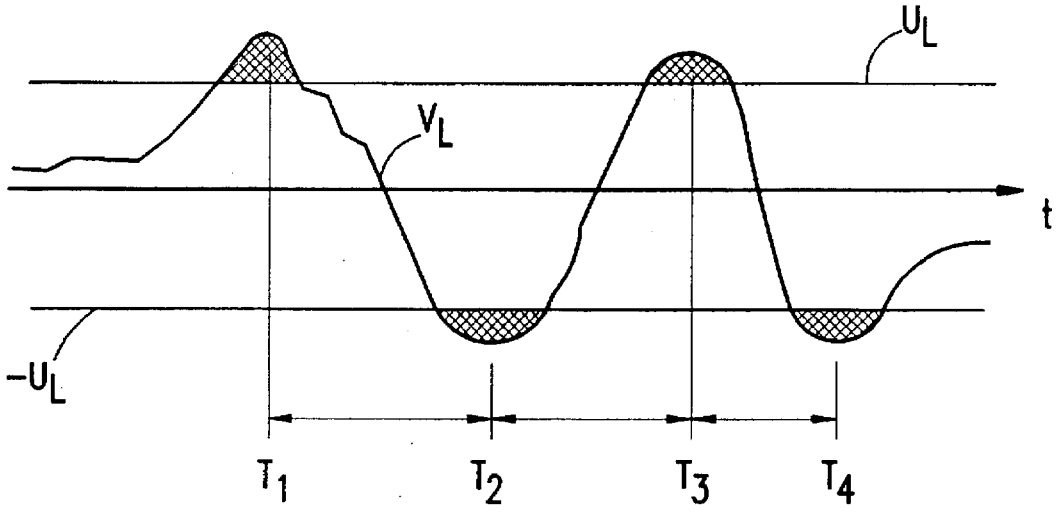
FIGS. 2A and 2B schematically illustrate a low frequency component and a high frequency component, respectively, of a typical low frequency signal in the circuitry of FIGS. 1A or 1B.
Figure 2B:
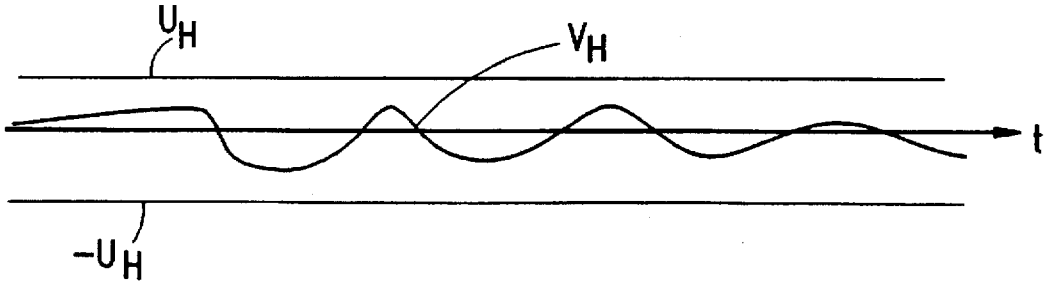
Figure 3A:
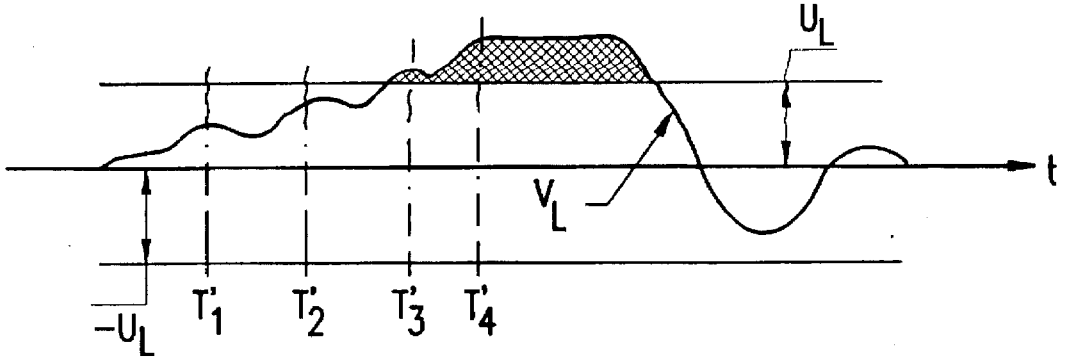
FIGS. 3A and 3B schematically illustrate a low frequency component and a high frequency component, respectively, of a typical high frequency signal in the circuitry of FIGS. 1A or 1B.
Figure 3B:
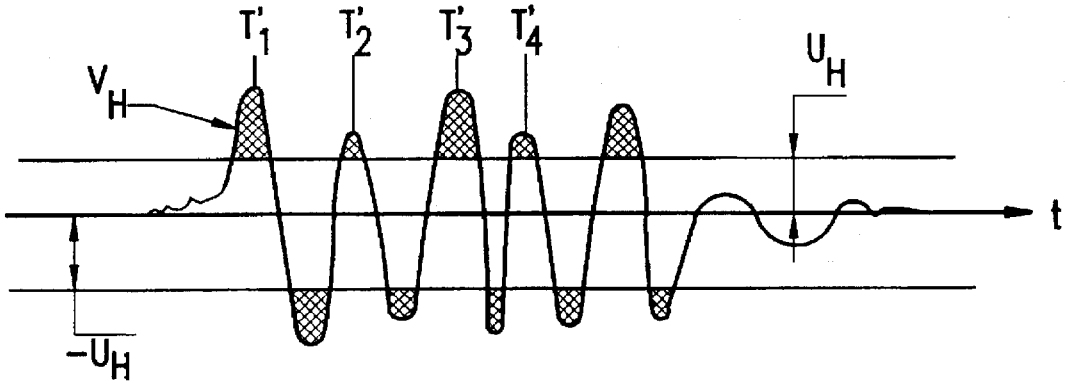

Reference is now made also to FIGS. 2A and 2B, which schematically illustrate amplified signal components $V_L$ and $V_H$, respectively, generated in response to a typical low frequency signal from sensor 12. Reference is also made to FIGS. 3A and 3B which schematically illustrate amplified signal components $V_L$ and $V_H$, respectively, of a typical high frequency signal from sensor 12.

The output of amplifier 14, $V_L$, is received by a first far-infrared-signal window comparator 18 and the output of amplifier 16, $V_H$, is received by a second far-infrared-signal window comparator 19. The outputs of window comparators 18 and 19, which are responsive to changes in the outputs of amplifiers 14 and 16, respectively, are provided as inputs to a main controller 20. Comparators 18 and 19 use detection "windows", $\pm U_L$ and $\pm U_H$, to evaluate the changes in outputs $V_L$ and $V_H$, respectively. The comparison between signals $V_L$ and $V_H$ and windows $\pm U_L$ and $\pm U_H$, respectively, is shown schematically in FIGS. 2A–3B. The detection windows used by comparators 18 and 19 are preferably continuously updated by controller 20 using feedback signals $U_L(t)$ and $U_H(t)$, respectively. Window update signals $U_L(t)$ and $U_H(t)$ are preferably generated by a window update circuit in controller 20 based on inputs responsive to changes in ambient conditions, particularly changes in temperature, which may affect the output of sensor 12.

In particular, as the background temperature increases, the difference in radiation between an intruder and the background decreases. This requires lower values of $U_L$ and $U_H$ to insure detection of intruders. However, such lower values also make the system more vulnerable to false alarms. Thus, the threshold levels are adjusted to take account of the required sensitivity required to assure detection of intruders, giving a minimum sensitivity as required by the expected difference between the background and the potential intruder.

When an intruder crosses the segmented field-of-view of the intrusion detector, the output of amplifier 14 and/or 16 changes abruptly and, consequently, window comparator 18 and/or 19 generates an intrusion detection signal to controller 20. An intrusion alarm circuit in controller 20, activated in response to the intrusion detection signal, provides an intrusion alarm signal which operates an audible or other alarm indication near the detector or at a remote monitoring station.

Additional, optional, features of the intrusion detector of the present invention are described in US. Pat. Nos. 5,237,300 and 4,604,524 and in Israel Patent Application 110,800, filed Aug. 28, 1994, which was filed in the PCT as application number PCT/EP95/01501, which are assigned to the assignee of the present application, the disclosures of all of which are incorporated herein by reference. For example, devices for detecting attempts to tamper with the intrusion detector may be used in conjunction with the present invention. The execution of such additional features is preferably also controlled by main controller 20.

Figure 1B:
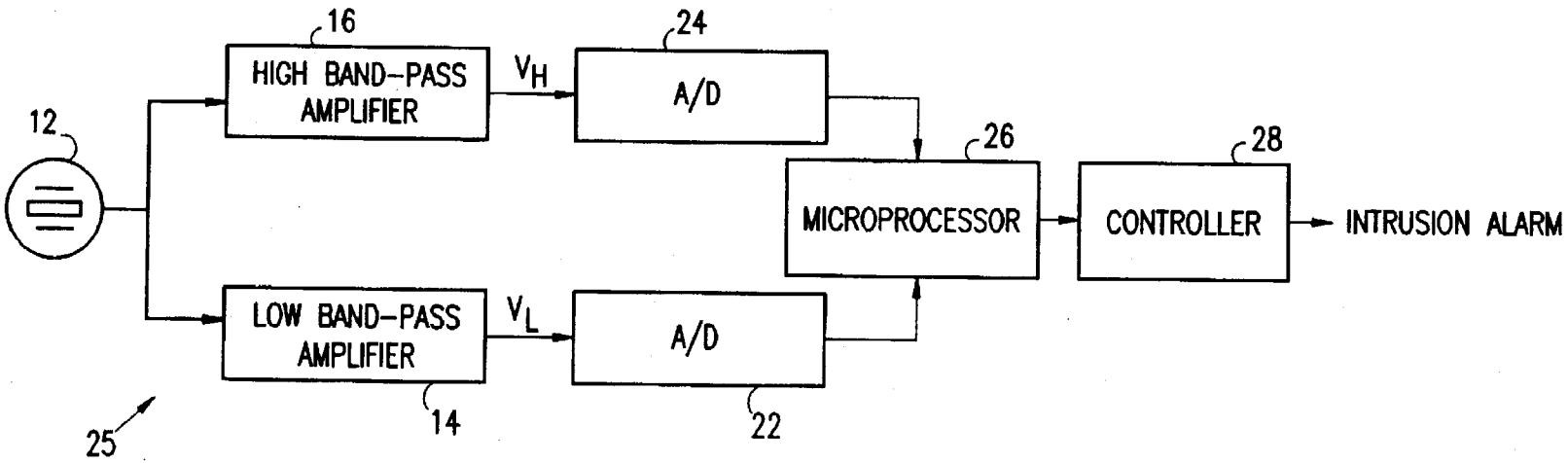
FIG. 1B is a schematic, block diagram, illustration of intrusion detection circuitry incorporating digital processing in accordance with another preferred embodiment of the present invention.

Reference is now made to FIG. 1B which schematically illustrates intrusion detection circuitry 25 in accordance with another preferred embodiment of the present invention. Circuitry 25 is connected to far infrared sensor 12, as in the embodiment of FIG. 1A, which produces an electric output in response to radiation in a far infrared wavelength range typical of the human body. As described above, sensor 12 views a plurality of fields-of-view of the supervised region, preferably through a segmented Fresnel lens. Thus, as described above, the electric output produced by sensor 12 includes a pulse for each time a far infrared source exits one of the fields-of-view and enters an adjacent field-of-view.

Figure 4A:
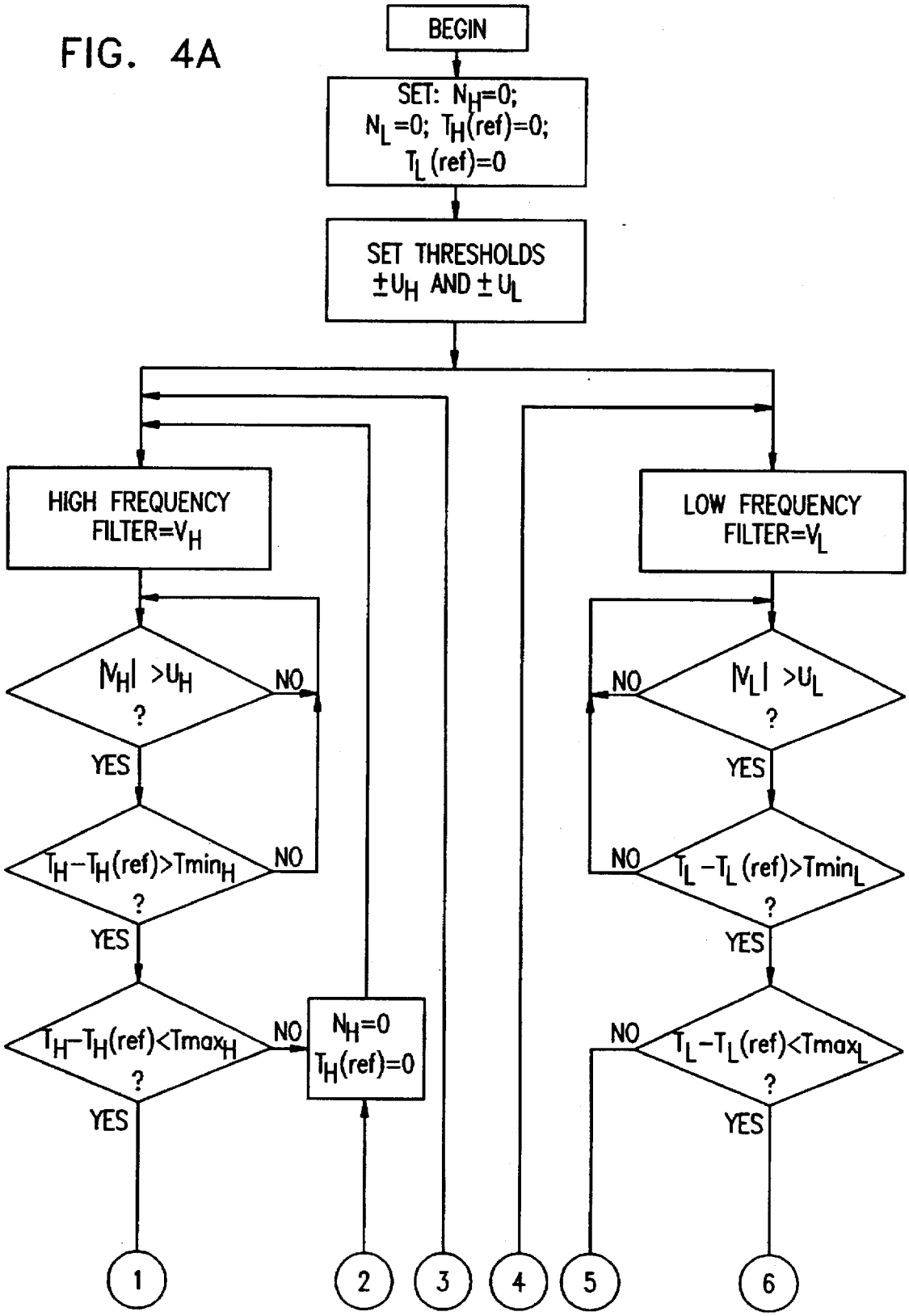
FIGS. 4A and 4B schematically illustrate a flow chart of a preferred algorithm for the digital processing incorporated by the circuitry of FIG. 1B.

As in the embodiment of FIG. 1A, the output signal produced by sensor 12 in FIG. 1B is amplified either by low frequency range amplifier 14 or by high frequency range amplifier 16, which are both connected to the output of sensor 12. When sensor 12 generates a low frequency signal, for example a signal responsive to a distant, slow moving, intruder, the signal is amplified by amplifier 14 to produce amplified signal $V_L$. When sensor generates a high frequency signal, for example a signal responsive to a near, fast moving, intruder, the signal is amplified by high frequency range amplifier 16 to produce an amplified signal $V_H$, The output of amplifier 14, $V_L$, is received by a first analog-to-digital (A/D) converter 22 and the output of amplifier 16, $V_H$, is received by a second A/D converter 24. The outputs of A/D converters 22 and 24, which correspond to the outputs of amplifiers 14 and 16, respectively, are provided as inputs to a signal processor 26, which preferably includes a microprocessor. Processor 26 generates an intrusion detection signal to a controller 28. An intrusion alarm circuit of controller 28, activated in response to the intrusion detection signal, provides an intrusion alarm output which operates an audible alarm or some other indication, near the detector or at a remote monitoring station. A preferred intrusion detection algorithm to be carried-out by processor 26 will now be described with reference to the schematic flow chart illustrated in FIGS. 4A and 4B.

In a preferred embodiment of the present invention, the algorithm carried out by processor 26 begins by initial setting or resetting of the following parameters:

$N_L$—the number of detection pulses detected in low frequency component $V_L$;

$N_H$—the number of detection pulses detected in high frequency component $V_H$;

$T_L$(ref)—reference time for pulses detected in low frequency component $V_L$; and $T_H$(ref)—reference time for pulses detected in high frequency component $V_H$.

Once the initial parameter values are set, processor 26 proceeds to set window thresholds $\pm U_L$ and $\pm U_H$, which are preferably determined in accordance with ambient conditions such as temperature, as described above with reference to comparators 18 and 19 in the embodiment of FIG. 1A. Once the thresholds are set, processor 26 compares the digitized and amplified signal components $V_L$ and $V_H$ to window thresholds $\pm U_L$ and $\pm U_H$, respectively. When $|V_{L>UL}$, processor 26 determines the time, $T_L$, of a potential detection pulse in signal $V_L$. Similarly, when $|V_H|>U_H$, processor 26 determines the time, $T_H$, of a potential detection pulse in signal $V_H$.

If the time interval between the pulse detection time, $T_L$ or $T_H$, and the respective reference time, $T_L$(ref) or $T_H$(ref), is within a time range $Tmin_L$ or $Tmin_H$ and $Tmax_L$ or $Tmax_H$, the respective detection pulse count, $N_L$ or $N_H$, is increased by one. If the time interval, $T_L-T_L$(ref) or $T_H-T_H$(ref), is shorter than its respective minimum time interval, processor 26 proceeds to search for the next detection pulse. If time interval $T_L-T_L$(ref) is longer than $Tmax_L$, the low frequency pulse count, $N_L$, remains unchanged and processor 26 proceeds to evaluate the high frequency pulse count $N_H$. If time interval $T_H-T_H$(ref) is longer than $Tmax_H$, pulse count $N_H$ and reference time $T_H$(ref) are reset to zero and processor 26 proceeds to search for the next high frequency pulse.

Figure 4B:
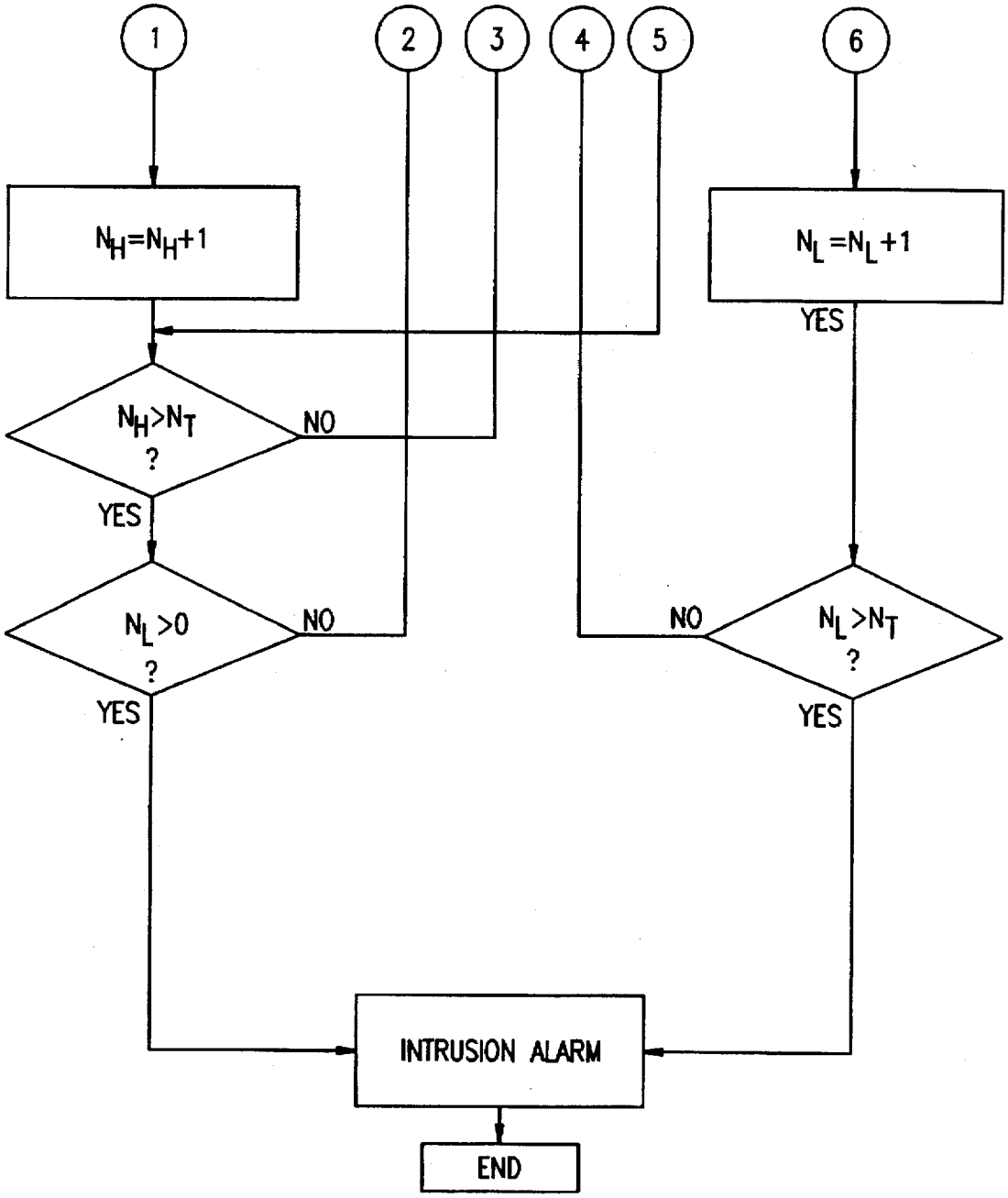

To avoid false alarms, a minimum number of high frequency detection pulses, $N_T$, are required for generating an intrusion alarm signal. As illustrated in FIG. 3B, when a near, fast moving intruder crosses the segmented field-of-view of the intrusion detector, a number of high frequency detection pulses are generated, e.g. at times $T_1'$, $T_2'$, $T_3'$ and $T_4'$. In some preferred embodiments of the present invention, the threshold number of detection pulses, $N_T$, required for intrusion detection is set to a value between 2 and 4. As shown in FIG. 3A, only one low frequency detection pulse is expected to be generated in response to the fast moving intruder and, thus, only one low frequency detection pulse is preferably required for generating an intrusion alarm signal. Thus, in a preferred embodiment of the present invention, an intrusion alarm signal will be generated only when $N_H>N_T$ and $N_L>0$, as illustrated in FIG. 4B.

As illustrated in FIG. 2A, when a far, slow moving intruder crosses the segmented field-of-view of the intrusion detector, a number of low frequency detection pulses are generated, e.g. at times $T_1$, $T_2$, $T_3$ and $T_4$. As described above, the threshold number of detection pulses, $N_T$, may be set, for example, to a value of between 2 and 4. As shown in FIG. 2B, no high frequency detection pulses are expected to be generated in response to a far, slow moving, intruder and, thus, no requirement is set on detection of high frequency pulses for generating an intrusion alarm signal. Thus, in a preferred embodiment of the invention, an intrusion alarm signal will be generated whenever $N_L>N_T$, as illustrated in FIG. 4B.

Figure 5:
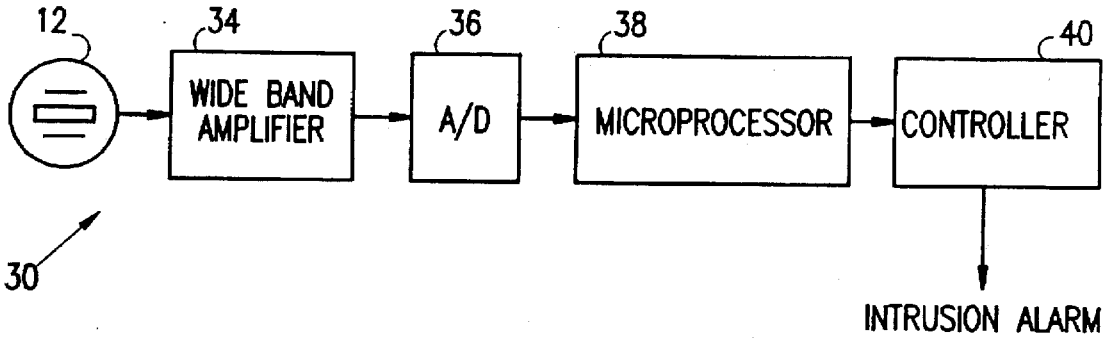
FIG. 5 is a block diagram of intrusion detection circuitry incorporating digital processing, in accordance with yet another preferred embodiment of the present invention.

Reference is now made to FIG. 5 which schematically illustrates intrusion detection circuitry 30 in accordance with yet another, preferred embodiment of the present invention. The circuitry of FIG. 5 includes a far infrared signal amplifier 34, preferably a wide range amplifier as is known in the art, which amplifies the output of far infrared sensor 12. The output of amplifier 34 is received by a signal processor 38 whose operation is different from that of prior art signal processors. The output of signal processor 38, which is responsive to variations in the output of amplifier 34, as described in detail below, is connected to an input of a controller 40. When an intruder crosses the segmented field-of-view of sensor 12, the output of amplifier 34 changes and, based on analysis of the amplified signal, processor 38 generates an intrusion detection signal to controller 40. An intrusion alarm circuit of controller 40, activated in response to the intrusion detection signal, then provides an intrusion alarm signal which operates an audible alarm or some other indication, near the detector or at a remote monitoring station, as described above.

Figure 6:
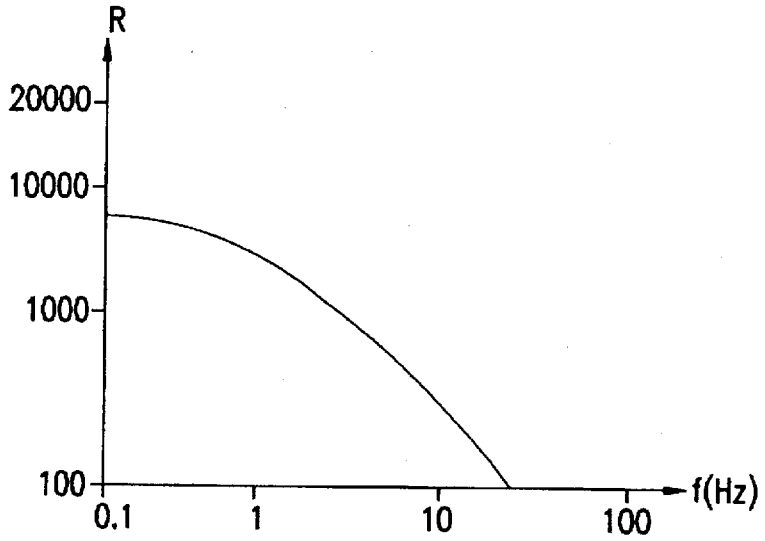
FIG. 6 is a graph generally illustrating the responsivity of a typical pyroelectric sensor as a function of the frequency of detection pulse generated thereby.

Reference is now made to FIG. 6 which schematically illustrates the responsivity of pyroelectric sensor 12, R, calculated as the electric power output of sensor 12 divided by the far infrared power illuminating the sensor, as a function of the frequency of detection pulses produced by the sensor. It should be noted that the responsivity of sensor 12 drops dramatically as the detection pulse frequency rises. This results in generation of low power, non-distinct peaks at high detection pulse frequencies, as described in detail below.

Figure 8A:
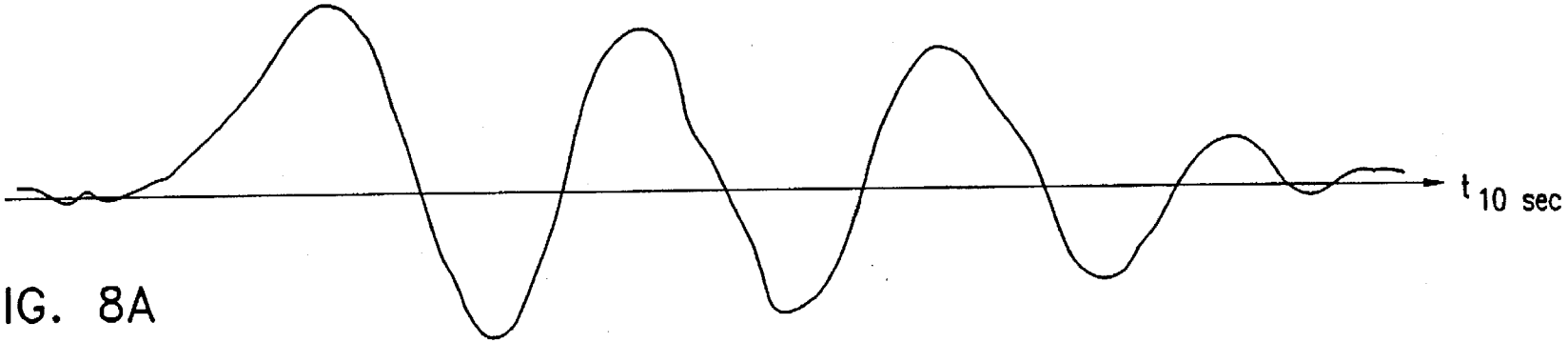
FIGS. 8A and 8B are schematic illustrations of a "normal" detection pulse frequency signal and a high detection pulse frequency signal, respectively, which may be processed by the circuitry of FIG. 5.
Figure 8B:
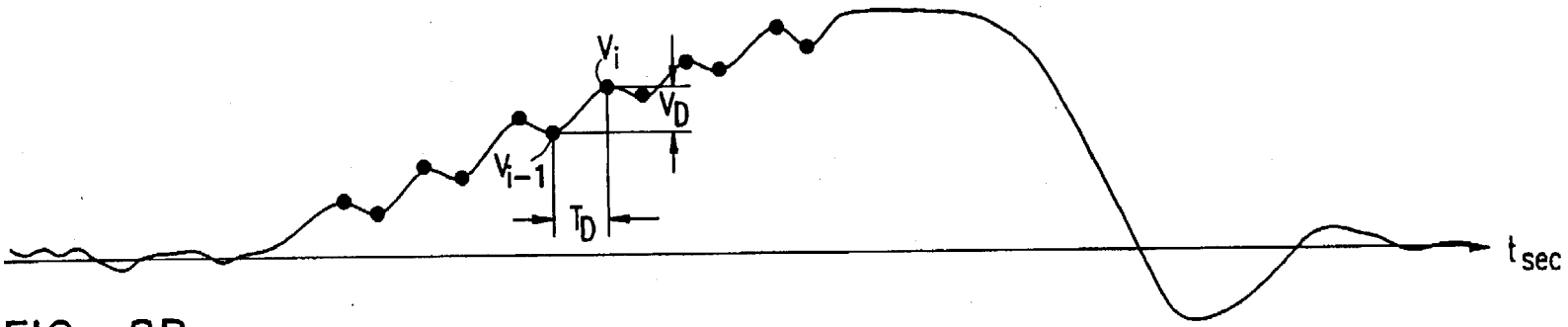

Reference is now made also to FIGS. 8A and 8B which schematically illustrate a "normal" detection pulse frequency signal and a high detection pulse frequency signal, respectively, both of which may be processed by the circuitry of FIG. 5. Note that the scales of FIGS. 8A and 8B are different with FIG. 8A showing about 10 seconds of a typical low frequency signal and FIG. 8B showing about one second of a typical high frequency signal. When the detection pulse frequency generated by sensor 12 is relatively high, typically more than about one pulse per second, the amplified detection pulses are not completely isolated, due to overlaps at the edges of adjacent pulses. Thus, at high detection pulse frequencies, the output of amplifier 34 includes a multi-peak pulse, hereinafter referred to as a super-pulse, which includes a series of narrow, local, detection peaks superposed on a single, wide, base pulse. An example of such a super-peak pulse is shown in FIG. 8B. Although each local peak in the super-pulse corresponds to a distinct sensor pulse, i.e. a distinct rise and drop in the output of sensor 12, wide range amplifier 34 cannot reproduce distinct detection pulses due to the inherent overlapping between consecutive peaks. Thus, typically, super-pulses generated by wide range amplifiers in response to detection pulse frequencies on the order of 2–4 Hz or higher, have the shape of a "rising staircase", whereby each local detection peak corresponds to a step in the "staircase". This is in contrast to the distinct detection pulses generated in response to slower moving intruders, as shown schematically in FIG. 8A.

It should be noted that the local peaks in the super-pulses are not detectable by the thresholding methods used in existing detectors. In prior art detectors, super-pulses are not distinguishable from isolated, single detection pulses because super-pulses and single pulses are both characterized by a single rise above a threshold and a single drop below the threshold. Since intrusion detection is preferably confirmed by detecting a number of consecutive pulses, to avoid false alarms, multi-peak super-pulses are generally ignored by existing detectors because they are mistaken to be single, isolated pulses. The present invention provides a method, preferably executed by hardware or software in signal processor 38, which overcomes this problem. A preferred digital processing algorithm for processor 38 will now be described with reference to the schematic flow chart illustrated in FIGS. 7A and 7B.

Figure 7A:
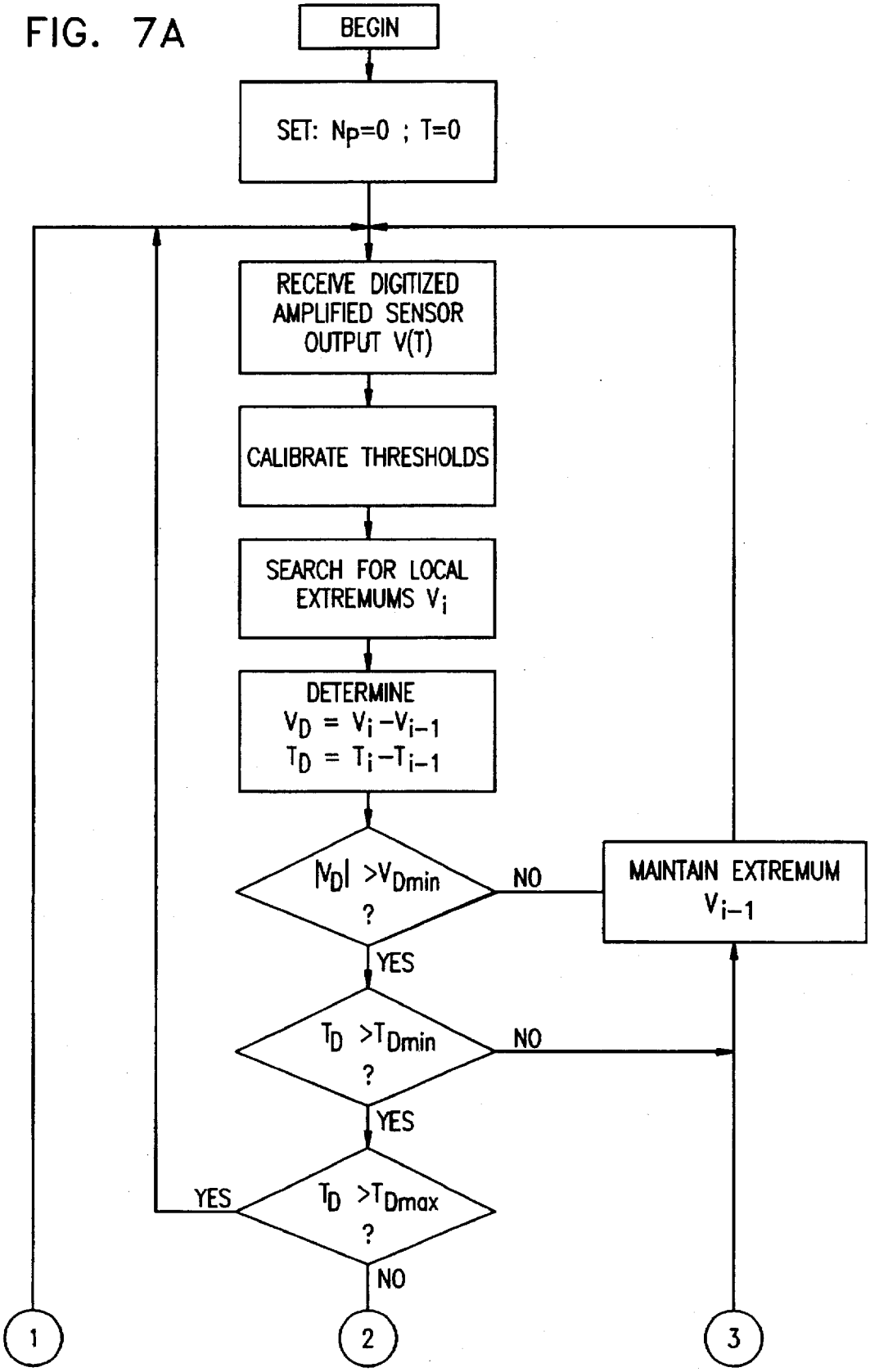
FIGS. 7A and 7B are a schematic flow chart of a preferred algorithm for the digital processing incorporated by the circuitry of FIG. 5.
Figure 7B:
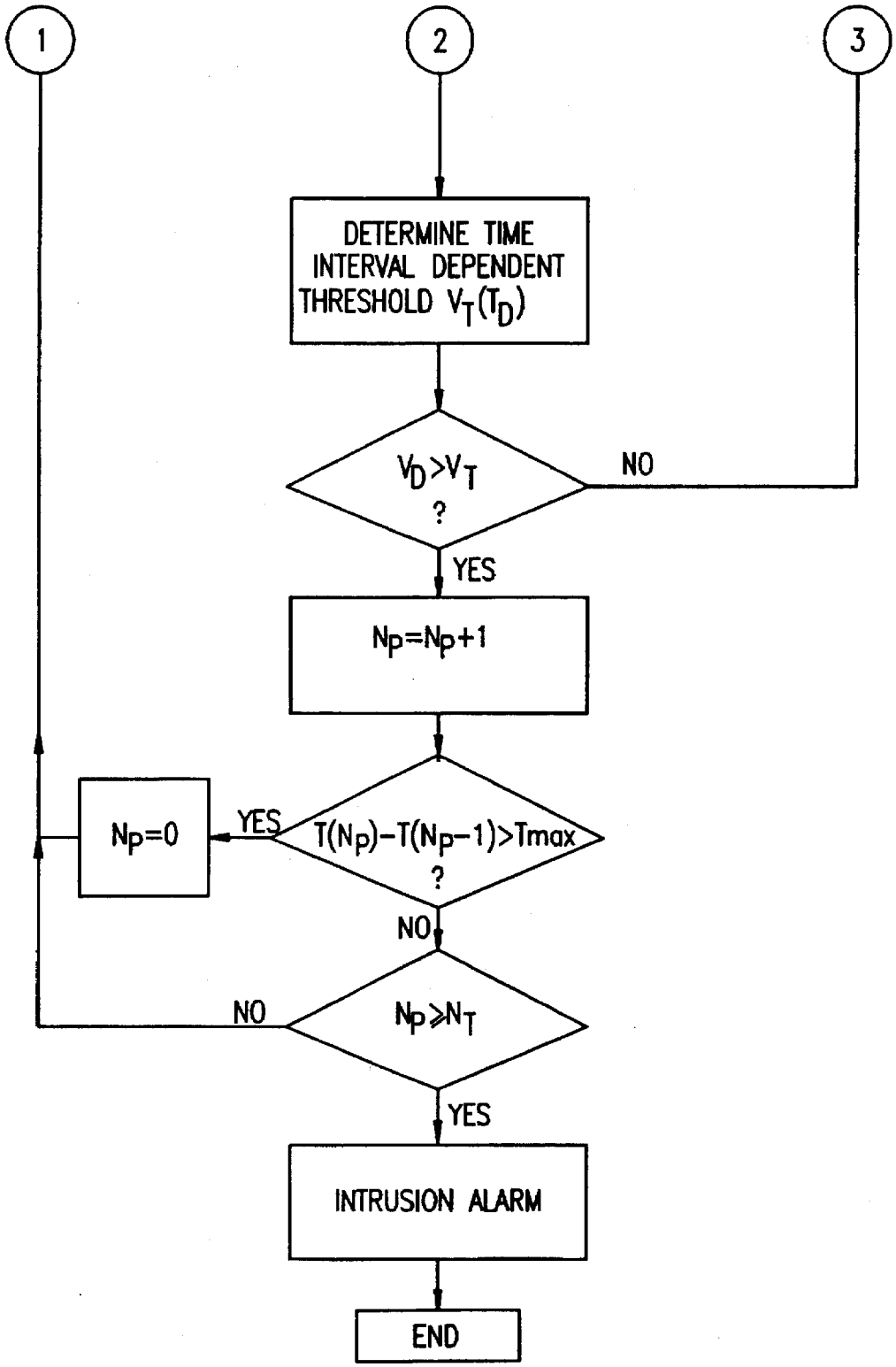

As shown at the top of FIG. 7A, the preferred algorithm begins by initial setting or resetting of the following parameters:

$N_P$—the number of detection pulses;

T—the time between consecutive detected intrusions.

Once the initial parameter values are set, processor 38 proceeds to calibrate signal amplitude thresholds $V_D$min and $V_T(T_D)$, which are defined below, preferably in accordance with ambient conditions such as temperature, as described above with reference to preceding embodiments. After calibrating the signal amplitude thresholds, processor 38 searches for local extrema $V_i$ in the digitized and amplified signal V(T). Processor 26 then determines the time, $T_D$, which lapsed from the last previous local extremum, $V_{i-1}$, in signal V(T).

Processor 38 also determines the absolute value of the amplitude change, $V_D$, between the last previous extremum, $V_{i-1}$, and the present extremum, $V_i$. If $|V_D| \leqq V_D$min, extremum $V_i$ is ignored and extremum $V_{i-1}$ is maintained as reference for the next extremum found in the search. If $|V_D| > V_D$min, processor 26 proceeds to evaluate the time interval between extrema $V_i$ and $V_{i-1}$. If time interval $T_D$ is longer than a minimum time interval, $T_D$min, and shorter than a maximum time interval, $T_D$max, processor 38 proceeds to perform a finer evaluation of difference signal $V_D$, as described below.

It will be appreciated from FIG. 8B that the change in amplitude between consecutive extrema is generally dependent on the time interval between the consecutive extrema. Thus, in a preferred embodiment of the present invention, processor 38 determines a time-interval-dependent threshold, $V_T(T_D)$, based on the predetermined relationship which generally exists between the time interval and amplitude change across consecutive extrema. The time-interval-dependent thresholds may be determined based on a look-up-table stored in a memory of processor 38. If $V_D| \leqq V_T$, extremum $V_i$ is ignored and extremum $V_{i-1}$ is maintained as reference for the next extremum found in the search. However, if $V_D > V_T$, the number of detected pulses is raised by one, i.e. N=N+1. Then, the time interval between consecutive detection pulses, $T(N_P)-T(N_P-1)$, is compared to a predetermined threshold, Tmax.

If $T(N_P)-T(N_P-1) \leqq$ Tmax, processor 38 proceeds to determine whether a threshold number of detection pulses, $N_T$, has been reached. If $N_P$ is greater than threshold number $N_T$, which is typically between 2 and 5, processor 38 generates an intrusion detection signal to controller 40 which operates an alarm circuit as described above. If $T(N_P)-T(N_P-1) >$ Tmax, the number of detection pulses, $N_P$ is reset to zero and the entire detection procedure described above is repeated to detect new pulses.

It should be appreciated that the present invention is not limited to what has been thus far described with reference to preferred embodiments of the invention. Rather, the scope of the present invention is limited only by the following claims:

U 010776-3

```
;***************************    *****************
;                                                *
;                APPENDIX A                      *
;                                                *
;************************************************
            LIST  C = 102
        org     0h
                btfsc  0x3,0x4          ;   0
                btfss  0x3,0x3          ;   1
                goto   LABAL4           ;   2
                goto   LABAL4           ;   3
   org    04h
    LABAL1      call   LABAL16          ;   4
                movlw  0x16             ;   5
                movwf  0x1              ;   6
                movlw  0x7              ;   7
                andwf  0xC,W            ;   8
                btfss  0x3,0x2          ;   9
                btfsc  0x2A,0x2         ;  10
                goto   LABAL5           ;  11
                goto   LABAL6           ;  12
    LABAL5      btfsc  0x2A,0x2         ;  13
                bsf    0x5,0x4          ;  14
                bsf    0x3,0x5          ;  15
                bsf    0x6,0x6          ;  16
                bcf    0x3,0x5          ;  17
                bcf    0x2A,0x5         ;  18
                btfsc  0x6,0x6          ;  19
                bsf    0x2A,0x5         ;  20
                bsf    0x3,0x5          ;  21
                bcf    0x6,0x6          ;  22
                bcf    0x3,0x5          ;  23
                bsf    0x8,0x2          ;  24
                movlw  0xF              ;  25
                btfsc  0x29,0x7         ;  26
                btfss  0x28,0x5         ;  27
                movlw  0x10             ;  28
                movwf  0xD              ;  29
                btfsc  0x2A,0x2         ;  30
                bsf    0x6,0x7          ;  31
   LABAL7       decfsz 0xD              ;  32
                goto   LABAL7           ;  33
                bcf    0x6,0x7          ;  34
                movlw  0x38             ;  35
                andwf  0x8              ;  36
                bsf    0x8,0x0          ;  37
   LABAL6       movlw  0x4              ;  38
                xorwf  0x2A             ;  39
                btfsc  0x28,0x7         ;  40
                goto   LABAL3           ;  41
                btfss  0x2A,0x5         ;  42
                goto   LABAL2           ;  43
                btfsc  0x2A,0x1         ;  44
                bcf    0x5,0x4          ;  45
                bsf    0x6,0x6          ;  46
                btfsc  0x29,0x2         ;  47
                bcf    0x6,0x6          ;  48
                bcf    0x6,0x3          ;  49
                btfss  0xC,0x7          ;  50
                goto   LABAL2           ;  51
                bsf    0x6,0x3          ;  52
                swapf  0x29,W           ;  53
                andlw  0x7              ;  54
                xorlw  0xFF             ;  55
```

```
                0x28,0x5
                btfss   ~~0x28,0x5~~        ;  56
                andwf   0x6                 ;  57
LABAL2          movf    0xC,W               ;  58
                andlw   0x7                 ;  59
                addwf   0x2                 ;  60
                goto    LABAL8              ;  61
                goto    LABAL9              ;  62
                goto    LABAL10             ;  63
                goto    LABAL99             ;  64
                goto    LABAL11             ;  65
                goto    LABAL102            ;  66
                goto    LABAL12             ;  67
LABAL3          bcf     0x5,0x4             ;  68
                movlw   0xF0                ;  69
                andwf   0x6                 ;  70
                movlw   0x44                ;  71
                btfss   0x28,0x5            ;  72
                movlw   0x43                ;  73
                iorwf   0x6                 ;  74
                goto    LABAL2              ;  75
LABAL15         bcf     0x3,0x0             ;  76
                rrf     0x22,W              ;  77
                sublw   0x49                ;  78
                btfss   0x3,0x0             ;  79
                goto    LABAL13             ;  80
                sublw   0x2A                ;  81
                btfss   0x3,0x0             ;  82
                goto    LABAL14             ;  83
                sublw   0x2A                ;  84
                addwf   0x2                 ;  85
LABAL13         retlw   0x7C                ;  86
                retlw   0x73                ;  87
                retlw   0x6E                ;  88
                retlw   0x6A                ;  89
                retlw   0x66                ;  90
                retlw   0x62                ;  91
                retlw   0x5E                ;  92
                retlw   0x5B                ;  93
                retlw   0x57                ;  94
                retlw   0x54                ;  95
                retlw   0x52                ;  96
                retlw   0x50                ;  97
                retlw   0x4D                ;  98
                retlw   0x4A                ;  99
                retlw   0x49                ; 100
                retlw   0x47                ; 101
                retlw   0x45                ; 102
                retlw   0x42                ; 103
                retlw   0x41                ; 104
                retlw   0x3F                ; 105
                retlw   0x3E                ; 106
                retlw   0x3D                ; 107
                retlw   0x3B                ; 108
                retlw   0x39                ; 109
                retlw   0x38                ; 110
                retlw   0x36                ; 111
                retlw   0x35                ; 112
                retlw   0x33                ; 113
                retlw   0x31                ; 114
                retlw   0x2E                ; 115
                retlw   0x2D                ; 116
                retlw   0x2A                ; 117
                retlw   0x29                ; 118
```

7/24/97

```
                0x27
        retlw   ~~0x27~~        ; 120
        retlw   0x27            ; 121
        retlw   0x27            ; 122
        retlw   0x28            ; 123
        retlw   0x29            ; 124
        retlw   0x2A            ; 125
        retlw   0x2D            ; 126
        retlw   0x31            ; 127
LABAL14 retlw   0x33            ; 128
LABAL4  call    LABAL16         ; 129
        bcf     0xB,0x7         ; 130
        decfsz  0x24            ; 131
        goto    LABAL4          ; 132
        decfsz  0x25            ; 133
        goto    LABAL4          ; 134
        movlw   0x10            ; 135
        tris    0x6             ; 136
        bsf     0xB,0x7         ; 137
        movlw   0x2E            ; 138
        movwf   0xC             ; 139
        movlw   0x2D            ; 140
        movwf   0x2B            ; 141
        clrf    0x1C            ; 142
        movlw   0x80            ; 143
        movwf   0x28            ; 144
        clrf    0x29            ; 145
        clrf    0x2A            ; 146
        movlw   0x18            ; 147
        movwf   0x24            ; 148
        clrf    0x25            ; 149
        movlw   0x68            ; 150
        movwf   0x22            ; 151
LABAL17 goto    LABAL17         ; 152
LABAL12 movlw   0x20            ; 153
        movwf   0xE             ; 154
        movwf   0x12            ; 155
        movwf   0x13            ; 156
        movwf   0x14            ; 157
        movwf   0x15            ; 158
        movwf   0x16            ; 159
        clrf    0x10            ; 160
        clrf    0x11            ; 161
        call    LABAL18         ; 162
        call    LABAL19         ; 163
        movlw   0x68            ; 164
        movwf   0xC             ; 165
        movlw   0x80            ; 166
        andwf   0x28            ; 167
        clrf    0x23            ; 168
        goto    LABAL24         ; 169
LABAL8  movf    0x9,W           ; 170
        addwf   0x10            ; 171
        btfsc   0x3,0x0         ; 172
        incf    0x11            ; 173
        decfsz  0xE             ; 174
        goto    LABAL24         ; 175
        rrf     0x1C,W          ; 176
        andlw   0x7C            ; 177
        movwf   0xD             ; 178
        btfsc   0x11,0x4        ; 179
        bsf     0xD,0x7         ; 180
        swapf   0x10            ; 181
        movlw   0xF             ; 182
```

```
                0x11
andwf   ~~0x~~          ; 184
swapf   0x11,W          ; 185
addwf   0x10            ; 186
movf    0x12,W          ; 187
movwf   0x11            ; 188
movf    0x10,W          ; 189
subwf   0x11            ; 190
btfss   0xD,0x7         ; 191
goto    LABAL29         ; 192
btfss   0xD,0x2         ; 193
goto    LABAL31         ; 194
goto    LABAL30         ; 195
LABAL29 btfss   0xD,0x2 ; 196
goto    LABAL30         ; 197
btfss   0x3,0x0         ; 198
goto    LABAL36         ; 199
LABAL32 clrf    0x11    ; 200
comf    0x11            ; 201
goto    LABAL36         ; 202
LABAL31 movf    0x11    ; 203
btfsc   0x3,0x2         ; 204
goto    LABAL32         ; 205
btfss   0x3,0x0         ; 206
goto    LABAL32         ; 207
goto    LABAL33         ; 208
LABAL30 btfsc   0x3,0x0 ; 209
goto    LABAL36         ; 210
LABAL33 comf    0x11    ; 211
incf    0x11            ; 212
LABAL36 movf    0x11,W  ; 213
subwf   0x17,W          ; 214
movwf   0x27            ; 215
btfsc   0x3,0x0         ; 216
goto    LABAL34         ; 217
incf    0x17            ; 218
comf    0x27            ; 219
incf    0x27            ; 220
goto    LABAL35         ; 221
LABAL34 btfss   0x3,0x2 ; 222
decf    0x17            ; 223
LABAL35 bcf     0xD,0x2 ; 224
movlw   0x7             ; 225
andwf   0x1C,W          ; 226
addwf   0xD,W           ; 227
movwf   0x1C            ; 228
btfss   0x28,0x7        ; 229
btfsc   0x2A,0x5        ; 230
goto    LABAL28         ; 231
movf    0x11,W          ; 232
movwf   0x2F            ; 233
movf    0x27,W          ; 234
movwf   0x2E            ; 235
movf    0x17,W          ; 236
movwf   0x2D            ; 237
movf    0x13,W          ; 238
movwf   0x2C            ; 239
movf    0x10,W          ; 240
movwf   0x2B            ; 241
bsf     0x29,0x1        ; 242
bsf     0x29,0x0        ; 243
LABAL28 movf    0x13,W  ; 244
movwf   0x12            ; 245
movf    0x14,W          ; 246
```

```
                movf    ~~0x__,W~~   0x15, W   ; 248
                movwf   0x14                   ; 249
                movf    0x16,W                 ; 250
                movwf   0x15                   ; 251
                movf    0x10,W                 ; 252
                movwf   0x16                   ; 253
                movf    0x27,W                 ; 254
                addwf   0x18                   ; 255
                btfsc   0x3,0x0                ; 256
                incf    0x19                   ; 257
                movf    0x17,W                 ; 258
                addwf   0x1A                   ; 259
                btfsc   0x3,0x0                ; 260
                incf    0x1B                   ; 261
LABAL38         decfsz  0xF                    ; 262
                goto    LABAL37                ; 263
                incf    0x1E                   ; 264
                bsf     0x2A,0x4               ; 265
LABAL37         movlw   0x11                   ; 266
                btfss   0x2A,0x4               ; 267
                movlw   0x9                    ; 268
                movwf   0x8                    ; 269
                bsf     0x3,0x5                ; 270
                movlw   0xF                    ; 271
                movwf   0x5                    ; 272
                clrf    0x8                    ; 273
                btfss   0x2A,0x4               ; 274
                bsf     0x8,0x0                ; 275
                bcf     0x3,0x5                ; 276
                goto    LABAL27                ; 277
LABAL11         bcf     0x3,0x6                ; 278
                bcf     0x28,0x6               ; 279
                btfss   0x28,0x7               ; 280
                goto    LABAL47                ; 281
                movlw   0xFA                   ; 282
                subwf   0x9,W                  ; 283
                btfss   0x3,0x0                ; 284
                goto    LABAL48                ; 285
                bsf     0x3,0x6                ; 286
                goto    LABAL49                ; 287
LABAL48         movlw   0x5                    ; 288
                subwf   0x9,W                  ; 289
                btfss   0x3,0x0                ; 290
LABAL49         bsf     0x28,0x6               ; 291
LABAL47         btfss   0x28,0x7               ; 292
                btfsc   0x2A,0x5               ; 293
                goto    LABAL50                ; 294
                movf    0x9,W                  ; 295
                movwf   0x2F                   ; 296
                movf    0x21,W                 ; 297
                movwf   0x2E                   ; 298
                movf    0x20,W                 ; 299
                movwf   0x2D                   ; 300
                movf    0x1C,W                 ; 301
                movwf   0x2C                   ; 302
                movf    0x22,W                 ; 303
                movwf   0x2B                   ; 304
LABAL50         movf    0x1E,W                 ; 305
                sublw   0x18                   ; 306
                btfss   0x3,0x0                ; 307
                goto    LABAL19                ; 308
                movlw   0x8                    ; 309
                subwf   0xC                    ; 310
```

```
                0xC,W
andwf           ~~0x1C,W~~          ; 312
btfss           0x3,0x2             ; 313
goto            LABAL58             ; 314
movlw           0x20                ; 315
xorwf           0x28                ; 316
btfss           0x2A,0x6            ; 317
bcf             0x6,0x5             ; 318
btfsc           0x2A,0x7            ; 319
btfss           0x2A,0x6            ; 320
goto            LABAL51             ; 321
bsf             0x6,0x5             ; 322
bcf             0x2A,0x6            ; 323
LABAL51         movlw   0x28        ; 324
addwf           0xC                 ; 325
incf            0x1F                ; 326
movf            0x1F,W              ; 327
sublw           0x64                ; 328
btfsc           0x3,0x0             ; 329
goto            LABAL58             ; 330
movlw           0x2                 ; 331
btfss           0x2A,0x0            ; 332
movlw           0x1                 ; 333
subwf           0x1C,W              ; 334
andlw           0x7                 ; 335
btfss           0x3,0x2             ; 336
goto            LABAL21             ; 337
goto            LABAL52             ; 338
LABAL58         call    LABAL15     ; 339
movwf           0x11                ; 340
movlw           0x7                 ; 341
andwf           0x1C,W              ; 342
btfss           0x3,0x2             ; 343
goto            LABAL61             ; 344
bcf             0x3,0x0             ; 345
rrf             0x11                ; 346
bcf             0x3,0x0             ; 347
rrf             0x11,W              ; 348
movwf           0x1D                ; 349
bcf             0x3,0x0             ; 350
rrf             0x1D                ; 351
LABAL61         movf    0x21,W      ; 352
subwf           0x9,W               ; 353
bsf             0x23,0x7            ; 354
btfss           0x3,0x0             ; 355
goto            LABAL62             ; 356
btfsc           0x3,0x2             ; 357
btfss           0x28,0x3            ; 358
bcf             0x23,0x7            ; 359
goto            LABAL59             ; 360
LABAL62         movwf   0xE         ; 361
comf            0xE                 ; 362
incf            0xE,W               ; 363
LABAL59         subwf   0x1D,W      ; 364
btfss           0x3,0x2             ; 365
btfss           0x3,0x0             ; 366
goto            LABAL60             ; 367
btfss           0x28,0x4            ; 368
goto            LABAL23             ; 369
btfss           0x28,0x3            ; 370
btfsc           0x23,0x7            ; 371
goto            LABAL63             ; 372
goto            LABAL22             ; 373
[illegible]                         ; 374
```

```
                LABAL23
                goto    ~~LAL 23~~      ; 376
                goto    LABAL22         ; 377
LABAL60         btfsc   0x28,0x4        ; 378
                goto    LABAL64         ; 379
                bsf     0x28,0x4        ; 380
                bsf     0x28,0x3        ; 381
                btfss   0x23,0x7        ; 382
                bcf     0x28,0x3        ; 383
                goto    LABAL20         ; 384
LABAL64         btfsc   0x28,0x3        ; 385
                goto    LABAL65         ; 386
                btfss   0x23,0x7        ; 387
                goto    LABAL22         ; 388
                bsf     0x28,0x3        ; 389
                goto    LABAL66         ; 390
LABAL65         btfsc   0x23,0x7        ; 391
                goto    LABAL22         ; 392
                bcf     0x28,0x3        ; 393
LABAL66         movlw   0x1             ; 394
                subwf   0x1F,W          ; 395
                btfss   0x3,0x0         ; 396
                goto    LABAL21         ; 397
LABAL52         movf    0x20,W          ; 398
                subwf   0x21,W          ; 399
                movwf   0xE             ; 400
                btfsc   0x3,0x0         ; 401
                goto    LABAL56         ; 402
                comf    0xE             ; 403
                incf    0xE             ; 404
LABAL56         movlw   0x4             ; 405
                subwf   0x1F,W          ; 406
                btfss   0x3,0x0         ; 407
                goto    LABAL55         ; 408
                movlw   0xA             ; 409
                subwf   0x1F,W          ; 410
                btfss   0x3,0x0         ; 411
                goto    LABAL54         ; 412
                movlw   0x1E            ; 413
                subwf   0x1F,W          ; 414
                btfsc   0x3,0x0         ; 415
                goto    LABAL53         ; 416
LABAL54         bcf     0x3,0x0         ; 417
                rrf     0x11            ; 418
                bcf     0x3,0x0         ; 419
                rrf     0x11,W          ; 420
                addwf   0x11            ; 421
                goto    LABAL53         ; 422
LABAL55         bcf     0x3,0x0         ; 423
                rrf     0x11            ; 424
LABAL53         movf    0x11,W          ; 425
                subwf   0xE,W           ; 426
                btfss   0x3,0x0         ; 427
                goto    LABAL21         ; 428
                incf    0x1C            ; 429
                bcf     0x2A,0x3        ; 430
                bcf     0x3,0x0         ; 431
                rrf     0x11            ; 432
                bcf     0x3,0x0         ; 433
                rrf     0x11,W          ; 434
                movwf   0x1D            ; 435
                movlw   0x2             ; 436
                btfsc   0x2A,0x0        ; 437
                movlw   0x3             ; 438
```

7/24/97

```
                0x7
        andlw   ~~0x~~-          ; 440
        btfss   0x3,0x2          ; 441
        goto    LABAL20          ; 442
LABAL57 bsf     0x28,0x0         ; 443
        movlw   0xB8             ; 444
        andwf   0x23             ; 445
        movlw   0x4              ; 446
        iorwf   0x23             ; 447
LABAL19 movlw   0x7              ; 448
        andwf   0x1C,W           ; 449
        btfss   0x3,0x2          ; 450
        decf    0x1C             ; 451
        movlw   0x7              ; 452
        andwf   0x1C,W           ; 453
        btfsc   0x3,0x2          ; 454
        bcf     0x28,0x4         ; 455
LABAL20 clrf    0x1E             ; 456
LABAL21 clrf    0x1F             ; 457
        movf    0x21,W           ; 458
        movwf   0x20             ; 459
LABAL22 movf    0x9,W            ; 460
        movwf   0x21             ; 461
        btfsc   0xC,0x1          ; 462
        return                   ; 463
LABAL23 movlw   0x1              ; 464
        movwf   0x8              ; 465
        movlw   0x8              ; 466
        goto    LABAL26          ; 467
LABAL9  decfsz  0xE              ; 468
        goto    LABAL24          ; 469
        btfss   0x2A,0x4         ; 470
        goto    LABAL71          ; 471
        btfsc   0x28,0x7         ; 472
        decfsz  0x2B             ; 473
        goto    LABAL89          ; 474
        bcf     0x28,0x7         ; 475
        bsf     0x29,0x3         ; 476
        bsf     0x2A,0x3         ; 477
        movlw   0x1              ; 478
        movwf   0x25             ; 479
        movwf   0x24             ; 480
LABAL89 rlf     0x18             ; 481
        rlf     0x19             ; 482
        rlf     0x18             ; 483
        rlf     0x19             ; 484
        movlw   0xA              ; 485
        btfsc   0x29,0x7         ; 486
        movlw   0xA              ; 487
        subwf   0x19,W           ; 488
        btfsc   0x3,0x0          ; 489
        goto    LABAL70          ; 490
        btfsc   0x29,0x7         ; 491
        goto    LABAL41          ; 492
        goto    LABAL39          ; 493
LABAL70 btfsc   0x29,0x7         ; 494
        goto    LABAL40          ; 495
        rlf     0x1A             ; 496
        rlf     0x1B             ; 497
        rlf     0x1A             ; 498
        rlf     0x1B,W           ; 499
        sublw   0x4              ; 500
        btfsc   0x3,0x0          ; 501
        goto    LABAL39          ; 502
```

```
            movlw   0x87          ; 504
            andwf   0x23          ; 505
            movlw   0x60          ; 506
            iorwf   0x23          ; 507
LABAL96     bcf     0x29,0x3      ; 508
            goto    LABAL97       ; 509
LABAL39     movlw   0x38          ; 510
            andwf   0x23,W        ; 511
            btfsc   0x3,0x2       ; 512
            goto    LABAL97       ; 513
            movlw   0x8           ; 514
            subwf   0x23          ; 515
            movlw   0x38          ; 516
            andwf   0x23,W        ; 517
            btfsc   0x3,0x2       ; 518
            bcf     0x28,0x1      ; 519
LABAL97     movlw   0x7           ; 520
            andwf   0x23,W        ; 521
            btfsc   0x3,0x2       ; 522
            goto    LABAL95       ; 523
            movlw   0x1           ; 524
            subwf   0x23          ; 525
            movlw   0x7           ; 526
            andwf   0x23,W        ; 527
            btfsc   0x3,0x2       ; 528
            bcf     0x28,0x0      ; 529
LABAL95     btfsc   0x29,0x7      ; 530
            goto    LABAL40       ; 531
LABAL44     btfsc   0x2A,0x7      ; 532
            goto    LABAL46       ; 533
LABAL45     decfsz  0x25          ; 534
            goto    LABAL43       ; 535
            decfsz  0x24          ; 536
            goto    LABAL43       ; 537
            movlw   0x18          ; 538
            movwf   0x24          ; 539
            btfsc   0x29,0x3      ; 540
            bsf     0x29,0x7      ; 541
            bsf     0x29,0x3      ; 542
            btfsc   0x2A,0x3      ; 543
            bsf     0x2A,0x7      ; 544
            bsf     0x2A,0x3      ; 545
            bsf     0x2A,0x6      ; 546
LABAL43     call    LABAL18       ; 547
LABAL71     incf    0xC           ; 548
            movlw   0x14          ; 549
            btfss   0x2A,0x4      ; 550
            goto    LABAL26       ; 551
            goto    LABAL25       ; 552
LABAL40     bcf     0x28,0x1      ; 553
            movlw   0x5F          ; 554
            btfss   0x29,0x4      ; 555
            movlw   0xB           ; 556
            andwf   0x29          ; 557
            btfss   0x29,0x4      ; 558
            bcf     0xC,0x7       ; 559
            goto    LABAL44       ; 560
LABAL46     btfsc   0x2A,0x3      ; 561
            goto    LABAL42       ; 562
            bcf     0x28,0x0      ; 563
            bcf     0x2A,0x7      ; 564
            movlw   0xEF          ; 565
            btfss   0x29,0x5      ; 566
```

7/24/97

```
                0x29
            andwf   ~~0x~~          ; 568
            btfss   0x29,0x5        ; 569
            bcf     0xC,0x7         ; 570
            goto    LABAL45         ; 571
LABAL41     bsf     0x28,0x1        ; 572
            bsf     0x29,0x5        ; 573
            bsf     0x29,0x6        ; 574
            call    LABAL76         ; 575
            goto    LABAL46         ; 576
LABAL42     bsf     0x28,0x0        ; 577
            bsf     0x29,0x4        ; 578
            bsf     0x2A,0x6        ; 579
            bsf     0x29,0x6        ; 580
            call    LABAL76         ; 581
            goto    LABAL43         ; 582
LABAL99     decfsz  0xE             ; 583
            goto    LABAL24         ; 584
            goto    LABAL26         ; 585
LABAL102    decfsz  0xE             ; 586
            goto    LABAL24         ; 587
            call    LABAL75         ; 588
            clrf    0x10            ; 589
            clrf    0x11            ; 590
            movlw   0xF8            ; 591
            andwf   0xC             ; 592
            movlw   0x20            ; 593
            goto    LABAL25         ; 594
LABAL10     movlw   0x9             ; 595
            movwf   0x8             ; 596
            bsf     0x3,0x5         ; 597
            bsf     0x8,0x0         ; 598
            bcf     0x3,0x5         ; 599
            bcf     0x2A,0x4        ; 600
            movf    0x9,W           ; 601
            subwf   0x22,W          ; 602
            btfsc   0x3,0x2         ; 603
            goto    LABAL27         ; 604
            btfsc   0x3,0x0         ; 605
            goto    LABAL79         ; 606
            incf    0x22            ; 607
            goto    LABAL27         ; 608
LABAL79     decf    0x22            ; 609
LABAL27     movlw   0x13            ; 610
LABAL26     incf    0xC             ; 611
LABAL25     movwf   0xE             ; 612
LABAL24     btfss   0x28,0x7        ; 613
            btfsc   0x2A,0x5        ; 614
            retfie                  ; 615
LABAL80     btfss   0x2A,0x2        ; 616
            retfie                  ; 617
            swapf   0x2F,W          ; 618
            andlw   0xC             ; 619
            movwf   0xD             ; 620
            btfsc   0x6,0x5         ; 621
            bsf     0xD,0x5         ; 622
            movlw   0x3             ; 623
            andwf   0x29,W          ; 624
            iorwf   0xD,W           ; 625
            movwf   0x6             ; 626
            movlw   0x1             ; 627
            xorwf   0x29            ; 628
            bcf     0x29,0x1        ; 629
            call    LABAL77         ; 630
```

```
            retfie                  ; 632
LABAL76     movlw   0x1             ; 633
            movwf   0x24            ; 634
            movwf   0x25            ; 635
            return                  ; 636
LABAL75     movlw   0xF             ; 637
            btfss   0x2A,0x5        ; 638
            goto    LABAL85         ; 639
            movlw   0x1F            ; 640
            btfsc   0x28,0x6        ; 641
            movlw   0xF             ; 642
            bsf     0x3,0x5         ; 643
            movwf   0x6             ; 644
            bcf     0x3,0x5         ; 645
            bsf     0x5,0x4         ; 646
            movlw   0x21            ; 647
            movwf   0x10            ; 648
LABAL88     decfsz  0x10            ; 649
            goto    LABAL88         ; 650
            movf    0x6,W           ; 651
LABAL85     movwf   0xE             ; 652
            clrf    0x10            ; 653
            btfsc   0x6,0x5         ; 654
            bsf     0x10,0x5        ; 655
            btfsc   0x3,0x6         ; 656
            bsf     0x10,0x4        ; 657
            movlw   0x10            ; 658
            btfsc   0x28,0x6        ; 659
            movlw   0x0             ; 660
            bsf     0x3,0x5         ; 661
            movwf   0x6             ; 662
            bcf     0x3,0x5         ; 663
            bcf     0x2A,0x0        ; 664
            btfsc   0xE,0x0         ; 665
            bsf     0x2A,0x0        ; 666
            swapf   0x29,W          ; 667
            andlw   0x7             ; 668
            iorwf   0x28,W          ; 669
            andlw   0x7             ; 670
            btfsc   0x3,0x2         ; 671
            goto    LABAL83         ; 672
            btfss   0x29,0x6        ; 673
            goto    LABAL86         ; 674
            bsf     0x10,0x2        ; 675
            btfsc   0x29,0x5        ; 676
            bsf     0x10,0x1        ; 677
            btfsc   0x29,0x4        ; 678
            bsf     0x10,0x0        ; 679
            bcf     0x29,0x2        ; 680
            bsf     0xC,0x7         ; 681
            btfsc   0xE,0x3         ; 682
            bsf     0x29,0x2        ; 683
            btfss   0x28,0x7        ; 684
            bsf     0x10,0x3        ; 685
            goto    LABAL83         ; 686
LABAL86     bcf     0x29,0x2        ; 687
            bcf     0x28,0x2        ; 688
            btfsc   0x28,0x1        ; 689
            btfss   0x28,0x0        ; 690
            goto    LABAL84         ; 691
            bsf     0x29,0x2        ; 692
            bsf     0x28,0x2        ; 693
LABAL84     btfss   0xE,0x2         ; 694
```

```
                LABAL81
                goto    ~~LA  31~~      ; 696
                goto    LABAL83         ; 697
LABAL81         movf    0x28,W          ; 698
                andlw   0x7             ; 699
                iorwf   0x10            ; 700
                btfsc   0xE,0x2         ; 701
                btfss   0xE,0x1         ; 702
                goto    LABAL82         ; 703
                goto    LABAL83         ; 704
LABAL82         bcf     0x10,0x0        ; 705
                bcf     0x10,0x1        ; 706
LABAL83         bcf     0x2A,0x1        ; 707
                btfss   0x2A,0x5        ; 708
                return                  ; 709
                movf    0x10,W          ; 710
                andlw   0x7             ; 711
                btfss   0x3,0x2         ; 712
                bsf     0x2A,0x1        ; 713
LABAL87         btfss   0x28,0x7        ; 714
                btfss   0x29,0x2        ; 715
                bsf     0x10,0x6        ; 716
                movf    0x10,W          ; 717
                movwf   0x6             ; 718
                return                  ; 719
LABAL16         movlw   0xA0            ; 720
                movwf   0xB             ; 721
                clrwdt                  ; 722
                clrf    0x1             ; 723
                movlw   0x88            ; 724
                bsf     0x3,0x5         ; 725
                movwf   0x1             ; 726
                bcf     0x3,0x5         ; 727
                return                  ; 728
LABAL18         movlw   0x40            ; 729
                movwf   0xF             ; 730
                clrf    0x18            ; 731
                clrf    0x19            ; 732
                clrf    0x1A            ; 733
                clrf    0x1B            ; 734
                return                  ; 735
LABAL77         rlf     0x2B            ; 736
                rlf     0x2C            ; 737
                rlf     0x2D            ; 738
                rlf     0x2E            ; 739
                rlf     0x2F            ; 740
LABAL78         return                  ; 741
                org     03ffh
                goto    LABAL4          ;1023
                END
```

We claim:

1. An intrusion detector for supervising a region comprising:

a sensor which views a plurality of fields-of-view of the region and provides an output responsive to motion of an infrared radiation source between the fields-of-view;

a first filter which provides a first filtered output based on a first, predetermined, detection pulse frequency range of the sensor output;

a second filter which provides a second filtered output based on a second, predetermined, detection pulse frequency range of the sensor output; and processing circuitry which receives the first and second filtered outputs and detects in at least one of the filtered outputs, a sequence of at least a predetermined number of detection pulses indicating an intrusion condition.

2. An intrusion detector according to claim 1 wherein the processing circuitry comprises a first comparator which compares the first filtered output to at least one first threshold and a second comparator which compares the second filtered output to at least one second threshold.

3. An intrusion detector according to claim 2 wherein said first comparator comprises a first window comparator and the at least one first threshold comprises first upper and lower thresholds and wherein said second comparator comprises a second window comparator and the at least one second threshold comprises second upper and lower thresholds.

4. An intrusion detector according to claim 3 wherein said first and second thresholds are dynamically adjusted based on ambient conditions.

5. An intrusion detector according to claim 2 wherein said first and second thresholds are dynamically adjusted based on ambient conditions.

6. An intrusion detector according to claim 2 wherein said first and second thresholds are dynamically adjusted based on feedback signals.

7. An intrusion detector according to claim 2 wherein the first filtered output has a series of extremum values, and said first threshold is dynamically adjusted based on a time interval between consecutive extremum values.

8. An intrusion detector according to claim 2 wherein the first filtered output has a series of extremum values, and said first threshold is dynamically adjusted based on an amplitude difference between consecutive extremum values.

9. An intrusion detector according to claim 1 wherein said processing circuitry comprises a digital processor.

10. An intrusion detector according to claim 1 wherein the first frequency range comprises a high frequency range and the second frequency range comprises a low frequency range.

11. An intrusion detector according to claim 10 wherein the first frequency range is between about 3 Hz to about 10 Hz.

12. An intrusion detector according to claim 11 wherein the second frequency range is between about 0.1 to about 3 Hz.

13. An intrusion detector according to claim 11 wherein the second frequency range is between about 0.1 to about 2 Hz.

14. An intrusion detector according to claim 10 wherein the second frequency range is between about 0.1 to about 3 Hz.

15. An intrusion detector according to claim 10 wherein the second frequency range is between about 0.1 to about 2 Hz.

16. An intrusion detector according to claim 10 wherein the processing circuitry detects in the low frequency range output a sequence of at least a first predetermined number of detection pulses indicating an intrusion condition.

17. An intrusion detector according to claim 16 wherein the first predetermined number of detection pulses is between 2 and 4.

18. An intrusion detector according to claim 10 wherein the processing circuitry detects in the low frequency range output a sequence of at least a first predetermined number of detection pulses and in the high frequency range output a sequence of at least a second predetermined number of detection pulses indicating together an intrusion condition.

19. An intrusion detector according to claim 18 wherein the second predetermined number of pulses is between 2 and 4.

20. An intrusion detector according to claim 18 wherein the first predetermined number of pulses is one.

21. An intrusion detector according to claim 1 comprising an alarm circuit which provides a sensible indication when said processing circuitry detects said sequence of detection pulses.

22. An intrusion detector according to claim 1 wherein the first and second filters comprise respective first and second amplifiers, such that the first and second filtered signals are amplified signals.

23. An intrusion detector according to claim 1 wherein the processing circuitry detects a series of extremum values in the first filtered output and determines motion of the infrared radiation source based on time and amplitude differences between at least some of the extremum values in the series.

24. A method of supervising a region, comprising:

viewing a plurality of fields-of-view of the region;

sensing incident infrared radiation from the region and providing a single sensor signal responsive to motion of an infrared radiation source between the fields-of-view;

detecting a series of extremum values in the sensor signal; and detecting motion of the infrared radiation source based on time and amplitude differences between at least some of the extremum values in said series.

25. A method according to claim 24 wherein detecting motion of the infrared radiation source comprises thresholding a given extremum value of the sensor signal using a threshold dependent on a time interval between the given extremum value and a preceding extremum value.

26. A method according to claim 25 and comprising dynamically adjusting said threshold in accordance with ambient conditions.

27. The method of claim 25 wherein thresholding a given value comprises using a threshold value dependent on an amplitude difference between the given extremum value and the preceding extremum value.

28. An intrusion detector for supervising a region comprising:

a sensor which views a plurality of fields-of-view of the region and provides a single output responsive to motion of an infrared radiation source between the fields-of-view;

a processor which detects a series of extremum values in the sensor output and determines motion of the infrared radiation source based on time and amplitude differences between at least some of the extremum values in said series.

29. An intrusion alarm according to claim 28 wherein the processor detects motion of the infrared radiation source by thresholding a given extremum value of the sensor signal using a threshold dependent on a time interval between the given extremum value and a preceding extremum value.

30. The intrusion detector of claim 29 wherein the threshold is dependent on an amplitude difference between the given extremum value and a preceding extremum value.

31. An intrusion detector for supervising a region comprising:

a sensor which views a plurality of fields-of-view of the region and provides an output responsive to motion of an infrared radiation source between the fields-of-view;

a first filter which provides a first filtered output based on a first, predetermined, detection pulse frequency range of the sensor output;

a second filter which provides a second filtered output based on a second, predetermined, detection pulse frequency range of the sensor output; and processing circuitry which receives the first and second filtered outputs and detects in either or both of the filtered outputs, a sequence of detection pulses indicating an intrusion condition, wherein the first frequency range is between about 3 Hz to about 10 Hz.

32. The intrusion detector of claim 31 wherein the second frequency range is between about 0.1 to about 3 Hz.

33. The intrusion detector of claim 32 wherein the second frequency range is between about 0.1 to about 2 Hz.

34. The intrusion detector of claim 31 wherein the second frequency range is between about 0.1 to about 2 Hz.

35. An intrusion detector for supervising a region comprising:

a sensor which views a plurality of fields-of-view of the region and provides an output responsive to motion of an infrared radiation source between the fields-of-view;

a first filter which provides a first filtered output based on a first, predetermined, detection pulse frequency range of the sensor output;

a second filter which provides a second filtered output based on a second, predetermined, detection pulse frequency range of the sensor output; and processing circuitry which receives the first and second filtered outputs and detects in either or both of the filtered outputs, a sequence of detection pulses indicating an intrusion condition, wherein the second frequency range is between about 0.1 Hz to about 3 Hz.

* * * * *